US007019637B1

(12) United States Patent
Johnson et al.

(10) Patent No.: US 7,019,637 B1
(45) Date of Patent: Mar. 28, 2006

(54) SYSTEMS AND METHODS FOR DETECTING AND PROCESSING

(75) Inventors: Michael M. Johnson, Livermore, CA (US); Ann S. Yoshimura, Tracy, CA (US)

(73) Assignee: Sandia National Laboratories, Livermore, CA (US)

( * ) Notice: Subject to any disclaimer, the term of this patent is extended or adjusted under 35 U.S.C. 154(b) by 152 days.

(21) Appl. No.: 10/402,383

(22) Filed: Mar. 28, 2003

(51) Int. Cl.
*G08B 1/00* (2006.01)

(52) U.S. Cl. ..... 340/531; 340/506; 340/522; 340/539.16; 340/539.17; 702/182; 702/188

(58) Field of Classification Search ..... 340/506, 340/521, 522, 531, 539.1, 539.16, 539.17; 702/182–185, 188; 700/29–30; 455/404.1
See application file for complete search history.

(56) References Cited

U.S. PATENT DOCUMENTS

| | | | | |
|---|---|---|---|---|
| 6,502,018 | B1 * | 12/2002 | Bessler | 701/29 |
| 2004/0012491 | A1 * | 1/2004 | Kulesz et al. | 340/506 |
| 2004/0204915 | A1 * | 10/2004 | Steinthal et al. | 702/188 |

OTHER PUBLICATIONS

Hall, M., "Germ Sensors to be placed in cities for bioterror alerts", *USA Today,* Jan. 23, 2003 (Yahoo! News).

Hewlett-Packard Company, "Hp Zero Latency Enterprise Framework for Homeland Security Solutions", Jul. 1, 2002, 11 pages, http://wp.bitpipe.com/resource/org_1000733242_857/homsecwp.PDF.

MetroGuard Homeland Security, Early Warning and Tactical Incident Management for Chemical, Biological, 2 pages, http://www.navalsupport.com/pdfs/MetroGuard_Homeland.pdf.

Miller, J., "U.S. Is Deploying a Monitor System for Germ Attacks", *The New York Times,* Jan. 22, 2003 (Yahoo! News).

Nicol, et al., "Large-Scale Information Systems", *Sandia Report,* Nov. 2000, 37 pages.

Oak Ridge National Laboratory, Fact Sheet—"SensorNet", 2 pages, http://www.ornl.gov/sci/engineering_science_technology/sms/Hardy Fact Sheets/Sensor Net.pdf.

* cited by examiner

*Primary Examiner*—Thomas Mullen
(74) *Attorney, Agent, or Firm*—Dorsey & Whitney, LLP

(57) ABSTRACT

Embodiments of the present invention provides systems and method for detecting. Sensing modules are provided in communication with one or more detectors. In some embodiments, detectors are provided that are sensitive to chemical, biological, or radiological agents. Embodiments of sensing modules include processing capabilities to analyze, perform computations on, and/or run models to predict or interpret data received from one or more detectors. Embodiments of sensing modules form various network configurations with one another and/or with one or more data aggregation devices. Some embodiments of sensing modules include power management functionalities.

36 Claims, 8 Drawing Sheets

SYSTEMS AND METHODS FOR DETECTING AND PROCESSING

STATEMENT REGARDING FEDERALLY-FUNDED RESEARCH

This invention was made with Government support under contract no. DE-AC04-94AL85000 awarded by the U.S. Department of Energy to Sandia Corporation.

FIELD OF THE INVENTION

The invention relates to systems and methods for distributed detecting, and particularly to the measurement, analysis, and interpretation of detected data.

BACKGROUND OF THE INVENTION

Simple detector systems widely used in the art are generally provided according to an isolated reporting configuration, as shown in FIG. 1. Each detector 1, 2, and 3 individually produces or transmits raw data to generate a result. In the configuration shown in FIG. 1, each of the detectors 1, 2, 3 generally must send raw detector data over a long distance to nodes 4, 5, or 6, respectively. Generally all data is transmitted regardless of its relevance to the end user. The operation of the detectors 1, 2, 3 is unaffected by any central decision making and is not influenced by any of the other detectors. Wireless telemetry systems are also widely used in the art for the transmission of detector data.

SUMMARY OF THE INVENTION

According to a first aspect of the present invention, a sensing module is provided including at least one interface coupleable to a detector, and at least one interface coupleable to an environmental sensor unit. A processor is configured to receive data from the detector and the environmental sensor unit during operation. At least one wireless modem is in communication with the processor, and at least one antenna is in communication with the wireless modem. A power module is provided coupleable to a power source and configured to provide power management for the wireless modem, processor, and environmental sensor unit.

In some embodiments, the sensing module is coupled to a biological, chemical, or radiological detector. In accordance with embodiments of the present invention, the wireless modem is configured to facilitate ad hoc networking. In an embodiment of the present invention, the wireless modem is configured to communicate according to a peer-to-peer protocol. In another embodiment, the wireless modem is configured to communicate according to a star topology protocol.

In some embodiments, the processor of the sensing module is configured to execute a model. The model can predict, analyze, and/or interpret data from one or more detectors in communication with the sensing module.

According to another aspect of the present invention, a system including a plurality of sensing modules is provided. The sensing modules, in some embodiments, form an ad hoc network. In one embodiment, the ad hoc network includes modules in communication using a peer-to-peer protocol. In another embodiment, the ad hoc network includes modules in communication using a star topology protocol. A network of sensing modules according to embodiments of the present invention may further include one or more aggregation devices receiving data from one or more sensing modules.

According to yet another aspect of the present invention, a method for detecting is provided. A sensing module is provided including a sensing module having a processor. Detector data is predicted based, at least in part, on a model executed by the processor. Data is received from a detector coupled to the module and an alarm is generated based, at least in part, on a comparison between the received data and the predicted data.

In another aspect, a method for detecting a condition and generating an alarm when the condition is detected is provided. Detector data is predicted based, at least in part, on a model of the condition: Data indicative of the condition is received and an alarm is generated based, at least in part, on a comparison between the received data and the predicted data. In some embodiments, the method further includes mediating communication between a detector and a wireless network while simultaneously mediating communication between a sensing module and an Ethernet network.

DETAILED DESCRIPTION OF THE INVENTION

Systems and methods provided by embodiments of the present invention provide sensing modules that couple processing power to detectors. A sensing module, as used herein generally refers to a device including a processor and an interface for communicating with one or more detectors. A sensing module, as used herein, is generally configured to collect or measure data from one or more detectors. In this manner, an 'intelligent' sensing module (or ISM) is provided, with processing power to manipulate data received from detectors and environmental sensors in communication with the module. In some embodiments, the processor in a sensing module executes a model that predicts or determines what one or more detectors in communication with the processor should be detecting in a particular situation. In some embodiments, the model executed by the processor predicts one or more detector values based on one or more environmental sensor measurements. In preferred embodiments, sensing modules are provided in communication with detectors that are capable of detecting chemical, biological, or radiological agents. Detectors in other embodiments detect other substances or events. Environmental sensors, as used herein, refer to sensors that monitor one or more parameters of the environment in which a sensing module is placed, including light, humidity, and the like, as described further below.

Figure 1:
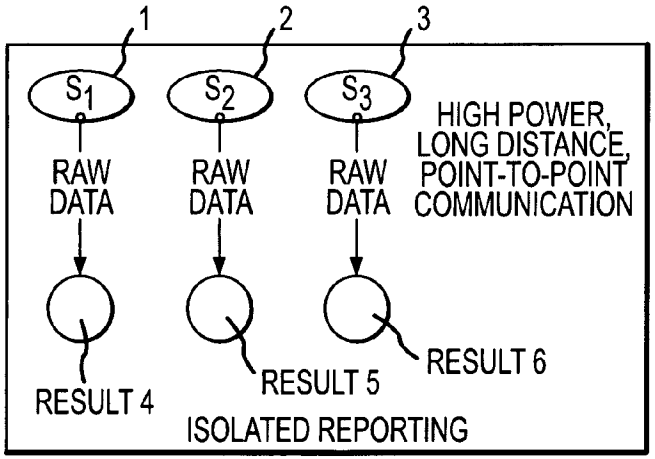
FIGURE 1 (PRIOR ART)
FIG. 1 depicts a prior art network configuration.
Figure 2:
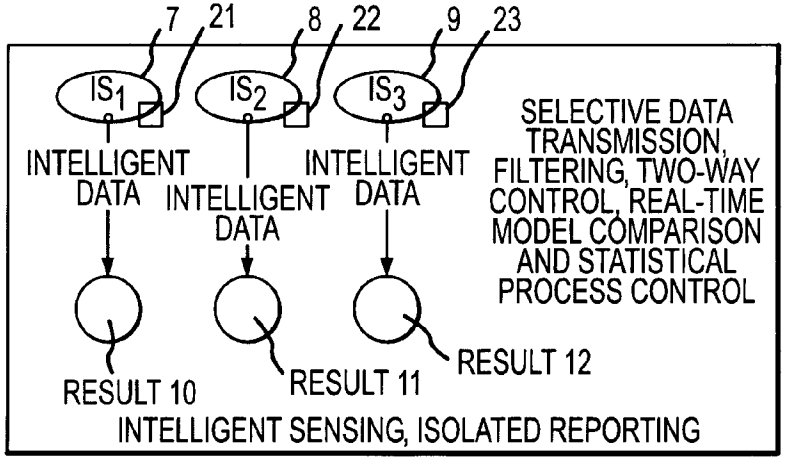
FIGS. 2–6 depict arrangements of sensing modules according to embodiments of the present invention.

Embodiments of the present invention provide systems including a plurality of sensing modules. One embodiment of an arrangement of sensing modules is shown in FIG. 2. Sensing modules 7, 8, and 9 are coupled to detectors 21, 22 and 23, respectively and provide intelligent data producing a result in nodes 10, 11, and 12, respectfully. By intelligent data, herein is meant that some processing has taken place on raw data detected by a detector. The configuration in FIG. 2 is sometimes referred to as an 'intelligent sensing, isolated reporting' embodiment herein. Accordingly, the arrangement depicted in FIG. 2 allows for selective data transmission, where only a particular subset of data collected by the detector 21, 22, or 23 associated with the sensing module 7, 8, or 9 is transmitted to node 10, 11, and 12 respectively. Embodiments of the invention arranged as shown in FIG. 2 further allow for two-way control, where control signals or commands can be transmitted to a processor associated with modules 7, 8, or 9 and used to modify or control the detectors associated with those modules. Further, the arrangement as shown in FIG. 2 allows for real-time model comparison where one or more models are executed by sensing modules 7, 8, or 9 and used to predict or interpret raw data received from associated detectors 21, 22, and/or 23. Statistical process control analysis may similarly be performed on received raw data by a sensing module.

Figure 3:
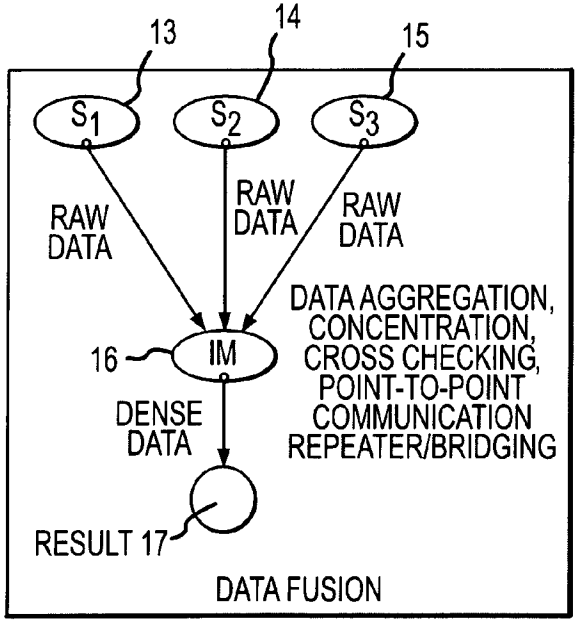

Still other embodiments of the present invention provide a plurality of sensing modules arranged in a 'data fusion' arrangement, as shown in FIG. 3. A plurality of detectors 13, 14, and 15 are coupled to a sensing module 16. Raw data is sent from the detectors 13, 14, and 15 to the sensing module 16. The sensing module can then perform data aggregation, concentration, cross-checking, point-to-point communication, and/or act as a repeater or bridge. The resultant 'dense data' is produced as a result 17. By 'dense data' herein is meant data originating from a plurality of detectors and processed.

Figure 4:
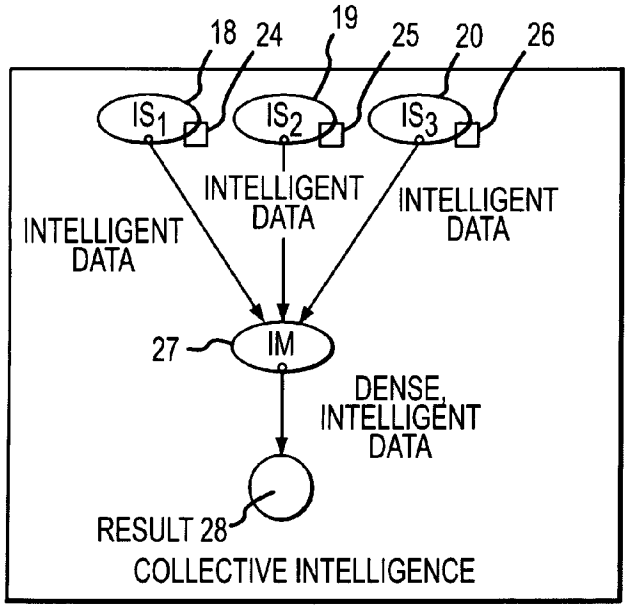

Yet other embodiments of the present invention provide a plurality of sensing modules arranged in a 'collective intelligence' arrangement, as shown in FIG. 4. Sensing modules 18, 19, and 20 coupled to detectors 24, 25, and 26, respectively send intelligent data to a sensing module 27. The sensing module 27 is an aggregation device, providing processing power to further process, analyze, and/or aggregate data received from sensing modules 18, 19, and 20. The sensing module 27 is then able to provide dense, intelligent data as a result in node 28. Although only one detector is shown coupled to each of sensing modules 18, 19, and 20, in FIG. 4, a plurality of detectors are coupled to the sensing modules 18, 19, and 20, according to some embodiments.

Figure 5:
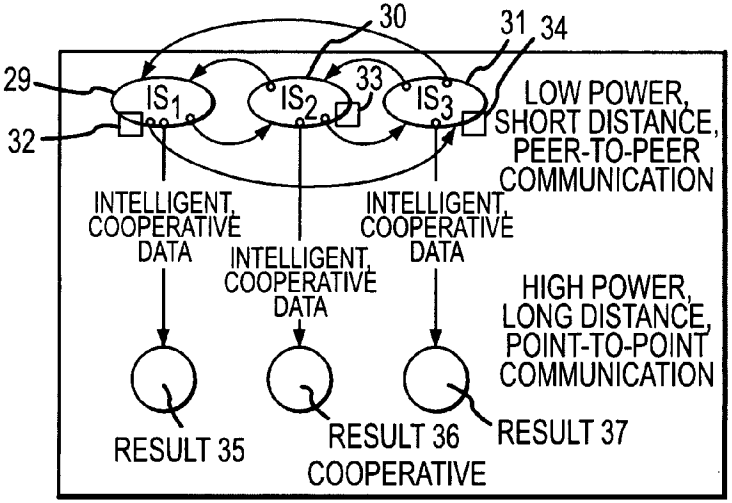

Other embodiments of the present invention provide a plurality of sensing modules arranged in a 'cooperative' configuration, as shown in FIG. 5. Sensing modules 29, 30, and 31, associated with detectors 32, 33, and 34, respectfully, communicate with one another according to a peer-to-peer protocol. Further, each of the sensing modules 29, 30, and 31 communicate intelligent, cooperative data to result nodes 35, 36, and 37, respectfully. By cooperative data, herein is generally meant data derived from communication between sensor modules. In the embodiment shown in FIG. 5, the sensing modules 29, 30, and 31 can exert a control signal on their associated detectors 32, 33, and 34 based on information from one or more of the other sensing modules. In preferred embodiments, communication between the sensing modules 29, 30, and 31 is by low power, short duration, peer-to-peer communication protocols, while communication between sensing modules 29, 30, and 31 and result nodes 35, 36, and 37 is by higher power, longer distance, point-to-point communication protocols.

Figure 6:
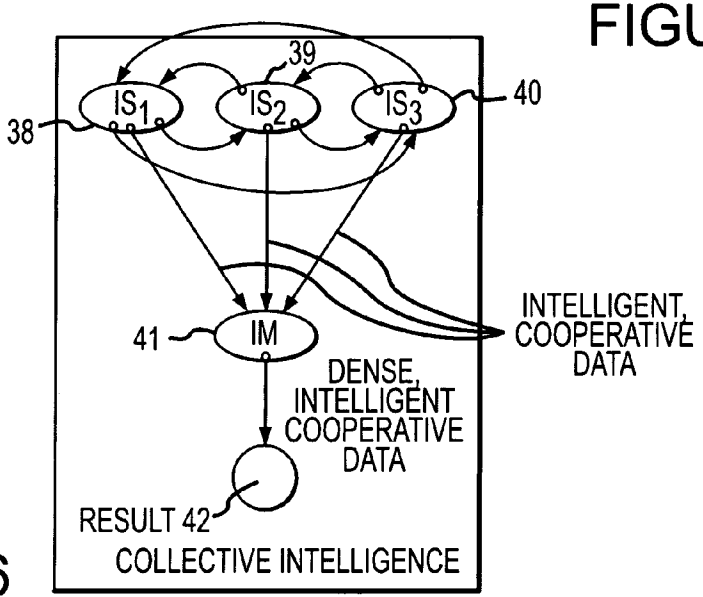

A preferred embodiment of the present invention is shown in FIG. 6, where the sensing modules 38, 39, and 40 are capable of communication with one another and each are capable of communication with a sensing module 41. Each of the sensing modules 38, 39, and 40 provide intelligent, cooperative data to the sensing module 41. The sensing module 41 provides dense, intelligent, cooperative data to a result node 42. The configuration shown in FIG. 6 is sometimes referred to as 'cooperative intelligence' herein.

Although a system of three sensing modules connected to a result node or another sensing module is shown in FIGS. 2–6 for ease of illustration, in some embodiments fewer than three sensing modules are present, and in other embodiments more than three sensing modules are present in a system.

In preferred embodiments, one or more sensing modules are in wireless communication with one another, according to any of the arrangements described above with regard to FIGS. 2–6. Sensing modules may be fixed or mobile. In some embodiments, sensing modules form an ad hoc network. In embodiments of the present invention, one or more data aggregation points are provided in connection with a plurality of sensing modules to further collect, process, and aggregate sensor and/or device data. As shown above, in FIGS. 4 and 6, an aggregation device may itself comprise a sensing module, such as the sensing module 27 in FIG. 4 and the sensing module 41 in FIG. 6.

Detectors in communication with sensing modules according to embodiments of the present invention may be integrated with the sensing module. However, in preferred embodiments at least one detector is external to the sensing module and in communication with the module through a detector interface. In some embodiments of the present invention, sensing modules further include an interface for communicating with one or more environmental sensors, or environmental sensor units. By environmental sensor unit herein is meant a device comprising a plurality of environmental sensors. Embodiments of sensing modules are also described in D. M. Nicol, et. al., "Large-Scale Information Systems" Sandia Report 2001-8086, unlimited release, printed November 2000, hereby incorporated by reference.

Figure 7:
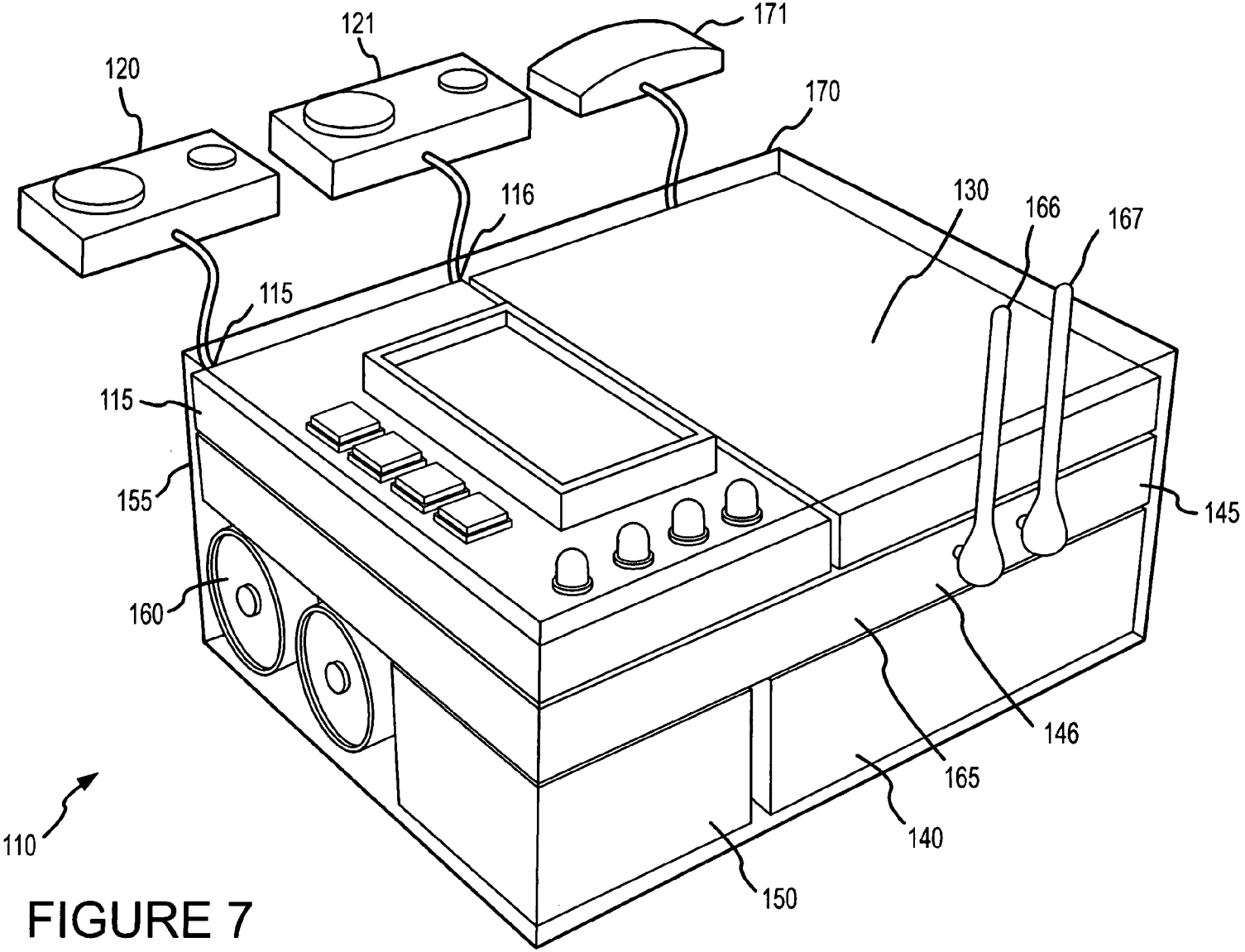
FIG. 7 depicts a sensing module according to an embodiment of the present invention.

An embodiment of a sensing module according to the present invention is shown in FIG. 7. A sensing module 110 includes a plurality of interfaces 115, 116, each coupleable to an environmental sensor unit 120, 121 which may include one or more sensors. Generally, any type of environmental sensor may be coupled to, or placed in communication with the sensing module 110 through a sensor interface. In some embodiments, environmental sensors are integral with or in communication with a sensing module, such as, for example, being integral with or in communication with a sensing module including but not limited to, a humidity sensor, light-level sensor, temperature sensor, magnetometer, accelerometer, and/or a vibration sensor, and the like. Environmental sensors according to embodiments of the present invention are generally simpler and have lower power requirements than detectors. Analog sensors may be integrated with a sensing module, for example, through the use of a serial interfaced analog-to-digital (A/D) converter. Further, in some embodiments, sensing modules are provided with or are in communication with one or more tamper sensors that provide an indication that the sensing module has or may have been tampered or interfered with, or that the sensing module was otherwise compromised. Sensing modules with tamper sensors can communicate a signal indicative of tampering or interference with the module. Accordingly, devices, other sensing modules, and/or aggregation devices can determine, based on a signal from a sensing module indicative of tampering, to disregard data transmitted by the compromised sensing module, or to take other action based on the compromised state of the module. In some embodiments, a data aggregation device and/or a sensing module is in communication with a closed-circuit television and/or a video recorder to record images in response to an alarm or other report.

The sensing module 110 further includes a processor 130. In some embodiments, the processor 130 includes an interface for communicating with one or more detectors. In accordance with embodiments of the present invention, detectors may include chemical, biological, and/or radiological detectors, detectors suitable for detecting chemical or biological warfare agents including anthrax, toxic chemicals, nerve agents, blister agents, blood agents, and/or choking agents. Detectors, in some embodiments, are large and require continuous external shore power, or the equivalent, for operation. That is, in operation and according to some embodiments of the invention, a detector may consume on the order of 10–90 Watts. In some embodiments, a CW Sentry Plus detector (Microsensor Systems, Inc.; Bowling Green, Ky.) is in communication with one or more sensing modules. Other commercial detectors may be used in some embodiments, including, but not limited to, GID-3™ (Graseby Dynamics, UK) and μChemLab (Sandia National Laboratories), MET-ONE (Met One Instruments, Inc.), S31 (S31, L.L.C.) Bioni (Pacific Scientific Instruments). In accordance with embodiments of the present invention, sensing modules include parsing and command and control for sensors and detectors such that a plurality of independent sensors and/or detectors not individually suited for communication with one another can be placed in communication with one another via the sensing module.

The processor 130 is generally configured at least to receive and/or manipulate data received from one or more detectors or to simulate or model data generated by one or more detectors. The particular processor used and processing capability required depends on the data being monitored or modeled by the detector or detectors in communication with or integral with the sensing module and the processing or data manipulations and speed desired. In one embodiment, an ISM includes a 200 MHz Intel StrongARM processor or a 400 MHz Intel XScale processor.

Still referring to FIG. 7, the sensing module 110 further comprises a wireless device 165, which can serve as a communications interface. In the embodiment shown in FIG. 7, a plurality of antennas 166, 167 are coupled to a plurality of modems 145, 146. Other means for communicating with other devices, and/or other sensing modules may also be provided. Further, in some embodiments, communication is protected through data integrity, confidentiality, and/or non-repudiation techniques, as known in the art. In a preferred embodiment, a sensing module includes one or more antennas for wireless communication. Accordingly, in some embodiments, a sensing module includes one or more wireless spread-spectrum modems. Embodiments of a sensing module may include a plurality of modems to support a plurality of communication protocols. Embodiments of a sensing module may include one or more modems configured to communicate according to the following protocols: a peer-to-peer protocol, a star topology protocol, and an analog cellular control channel protocol, as described further below.

In other embodiments, where other communication techniques are used, sensing modules include a suitable interface, for example a fiber optic interface and/or an Ethernet or other wired network interface, such as an RJ-45 connector or the like. In some embodiments, a single sensing module is provided with a plurality of communication means, including any combination of the above.

In some embodiments, one or more sensing modules are suitable for deployment in a harsh environment. Referring to FIG. 7, an enclosure 170 is provided in preferred embodiments suitable for placing the sensing module 110 in a harsh environment. For example, in one embodiment, the enclosure 170 is waterproof and/or weatherproof. Accordingly, in some embodiments environmental sensors and/or detectors included in or in communication with a sensing module are likewise suitable for deployment in a harsh environment. So, for example, in some embodiments commercial sensors, such as but not limited to those described above are modified, such as by making modifications to one or more electrical connection plates or locations and exhaust fans such that the sensor is able to tolerate exposure to, for example, a water washdown.

Further, sensing modules generally include some data storage capability, that is, generally computer-readable memory including, but not limited to, RAM, ROM, flash memory, or a microdrive. Accordingly, a sensing module, in a preferred embodiment, caches all, or some, data received from one or more sensors or detectors locally.

As shown in FIG. 7, in some embodiments, the sensing module 110 further includes additional features, such as, but not limited to, a GPS antenna 171, a power source 160, a peripheral module 155, a global positioning system (GPS) 150, and a power module 140.

The power source 160 may include batteries, solar cells, and the like. In embodiments of sensing modules including a power source, power management capabilities may further be provided in hardware and/or software. Accordingly, embodiments of sensing modules according to the present invention may monitor and report battery level, power conditioning, and, in some embodiments, are capable of operation for a duration of time without an external power source. The size and type of power source provided and the length of time a particular sensing module can go without external power are determined by the type and kind of data the sensing module is collecting and the type and frequency of communication between the sensing module and other devices. In one embodiment, a sensing module can go for 4 hours without external power, using a 7.2 Amp-hr battery supplying approximately 650 mA.

Figure 8:
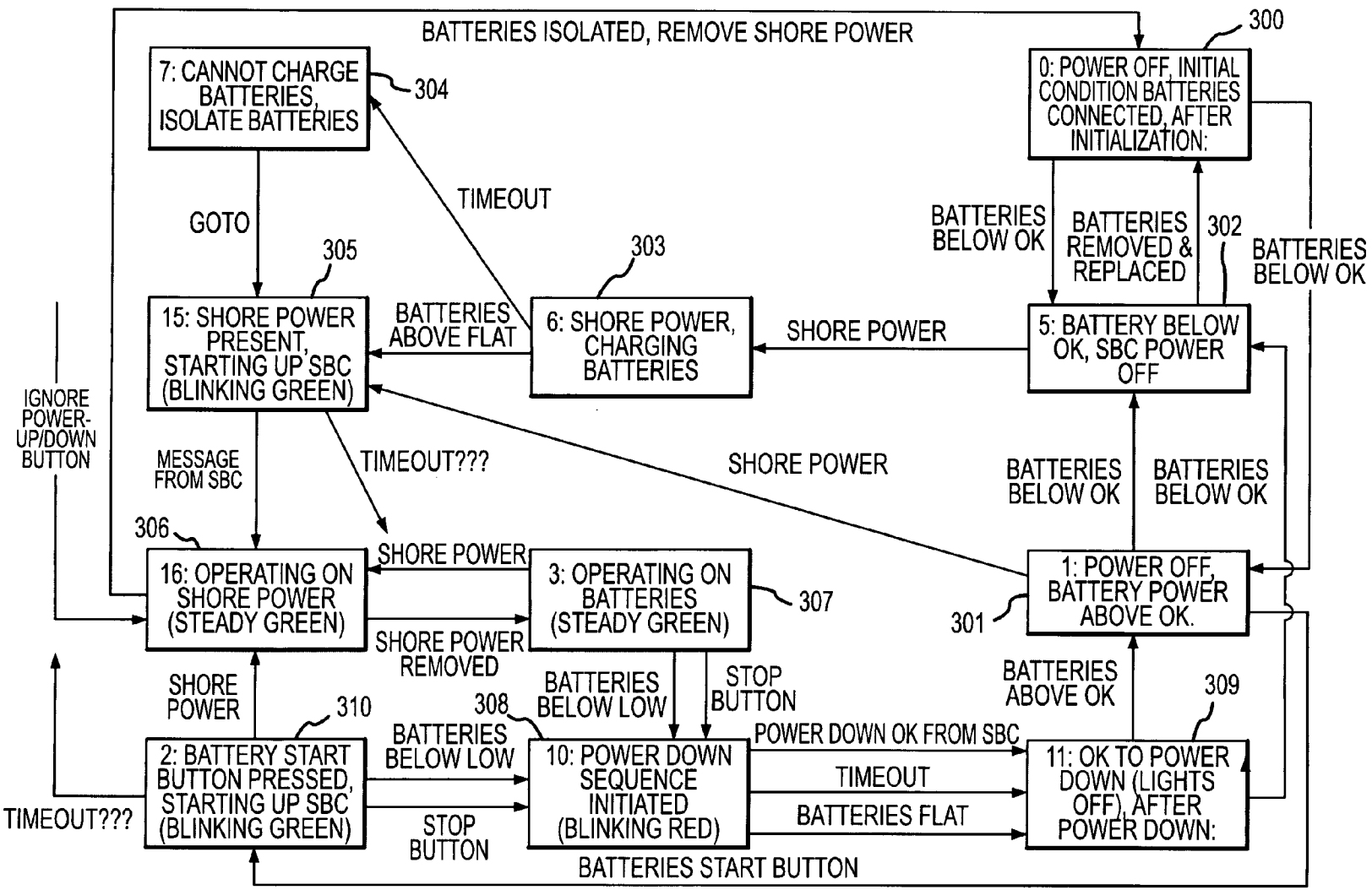
FIG. 8 depicts a state diagram of a method for power management according to an embodiment of the present invention.

FIG. 8 depicts a state diagram of a method for power management according to an embodiment of the present invention. At a state 300, power is off and batteries have been initially connected. If the battery charge is above a threshold level ("OK"), a state 301 is entered indicating power off and battery OK. From state 300, if the battery charge is below a threshold level, a state 302 is entered, indicative of battery level below OK and processor power off. From state 302, if shore power is supplied, a state 303 is entered indicative of shore power on and batteries charging. From state 303, if a timeout is encountered, a state 304 is entered indicative of an inability to charge batteries, and isolation of the batteries, followed by entering a state 305 indicative of shore power present, starting up the processor. In some embodiments, an indicator is provided, such as a blinking green light, as a visual confirmation of the state 305. From the state 303, if the battery charge level is above a flat level, the state 305 is entered. From state 305, if a message from the processor is received, a state 306 is entered indicative of operating on shore power. In some embodiments, a visual indicator of the state 306 is provided, such as a steady green light. From the state 306, if batteries are isolated and shore power is removed, the state 300 is entered. From the state 306, if shore power is removed, a state 307 is entered indicative of operating on batteries. In some embodiments, a visual indicator of the state 307 is provided, such as a steady green light. From the state 307, if shore power is provided, the state 306 is entered. From the state 307 if a stop button or other stop interface is engaged, a state 308 is entered indicative of the initiation of a power down sequence. In some embodiments, a visual indicator is provided for state 308, such as a blinking red light. Similarly, from the state 307, if the batteries are below a low level, the state 308 is entered. From the state 308, if a power down OK message is received from the processor, if a timeout is indicated, and/or if the batteries are at a flat level, a state 309 is entered indicative of OK to power down, and in some embodiments any visual indicators are disabled at power down and/or a different visual signal indicative of the state 309 is provided. From the state 309, if battery level falls below an OK level, the state 302 is entered. From the state 309, if the battery level is above an OK level, the state 301 is entered. From the state 301, if the battery level is below OK, the state 302 is entered. From the state 301, if a battery start button or other interface is engaged, a state 310 is entered indicative of starting up. In some embodiments a visual indicator, such as a blinking green light, is provided to indicate the state 310. From the state 310, if the battery level is below a low level, the state 308 is entered. If a stop button, or other stop interface is engaged from state 310, the state 308 is similarly entered. From the state 310, if shore power is returned, the state 306 is entered. Accordingly, power conditioning provides for switching between shore and battery power in a reliable manner based, in some situations, on the availability of shore power and/or the availability of battery or other internal power supply level.

Figures 9, 9A:
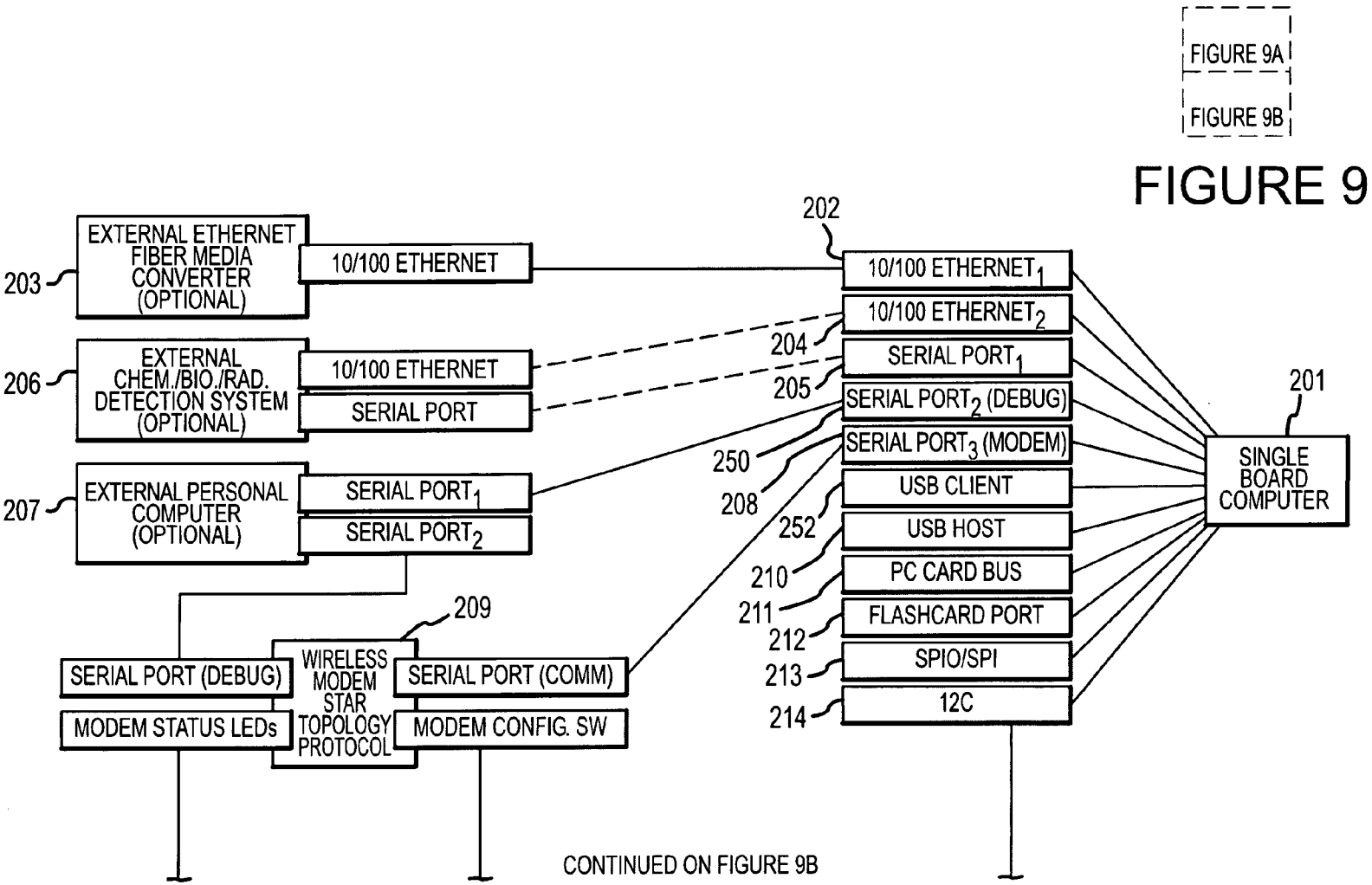
FIG. 9 provides an overview of hardware provided in a sensing module, according to an embodiment of the present invention.
Figure 9B:
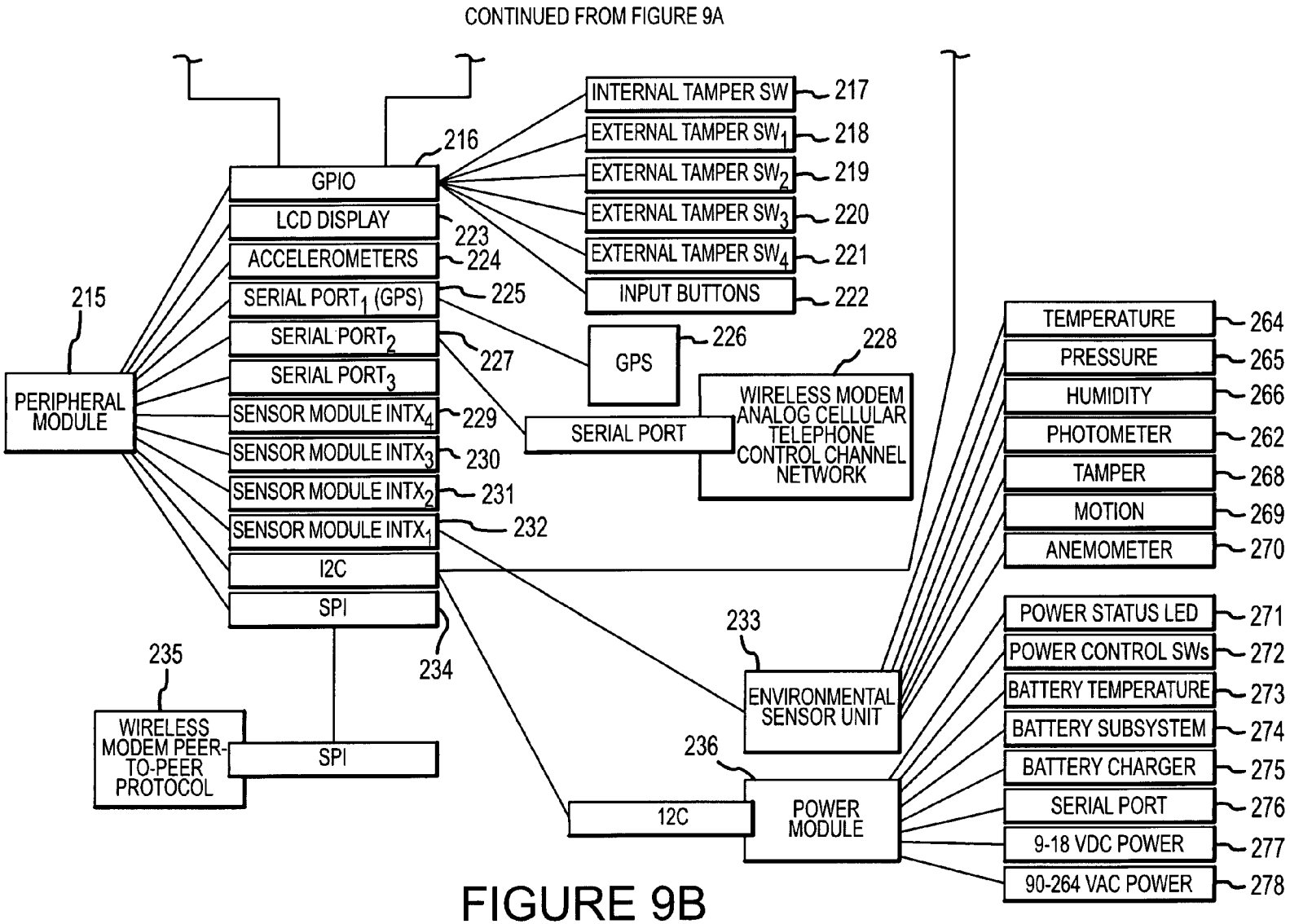

One embodiment of hardware generally provided in a sensing module is depicted in FIG. 9. In a preferred embodiment, the sensing module includes a single board computer (SBC) 201. However, in some embodiments a plurality of boards are provided. In other embodiments, a physical board is not required. As described generally above, interface components available on the board 201 may include one, all or a subset of the following: an Ethernet interface 202 for optional connection to an external Ethernet media converter 203, an Ethernet interface 204 and/or a serial port 205 for connection to a detector 206, such as a chemical biological, or radiological detector, a serial port 250 for optional connection to an external computer 207, a serial port 208 for connection to a wireless modem configured to communicate according to a star topology 209, a USB client interface 252, a USB host interface 210, for optional connection to one or more USB devices, a PC-CARD or PCMCIA interface 211, and/or a flashcard port 212 for connection to a storage device, a special peripherals input/output (SPIO) interface 213 for optional connection to a modem, and a 12C interface 214 for communication with peripheral module 215 and power module 236.

The peripheral module 215 is further provided with a plurality of interfaces including all, one, or a subset of the following: a peripherals input/output interface 216 for connection with the modem 209 and/or optional internal tamper sensor 217 and/or external tamper sensors 218–221, and optional input interface 222; an LCD display 223, one or more accelerometers 224, a serial port 225 for optional communication with GPS 226, a serial port 227 for optional communication with a wireless modem configured to communicate using analog cellular control channels 228; a plurality of interfaces 229–232, such as USB interfaces or serial ports, for communicating with one or more environmental sensor units, such as environmental sensor unit 233; an SPI interface 234 for optional communication with a wireless modem configured to communicate according to a peer-to-peer protocol 235.

The environmental sensor unit 263 is in optional communication with a plurality of environmental sensors such as, but not limited to, a temperature sensor 264, a pressure sensor 265, a humidity sensor 266, a photometer sensor 267, a tamper sensor 268, a motion sensor 269, an anemometer 270.

The power module 266 is in optional communication with a plurality of components including, but not limited to, a power status LED 271, a power control software 272, a battery temperature sensor 273, a battery subsystem 274, a battery charger 275, a serial port 273, a 9–18 V DC power interface 277, and a 90–264 V A/C power interface 278.

Embodiments of a sensing module may further include a sync pulse receiver and a data receiver for communication with other sensing modules. In some embodiments, a hybrid IC is provided to decode and encode message. Accordingly, sensor and/or detector data taken, measured, or otherwise received at a sensing module is digitized, sent to a microprocessor, analyzed, encoded and transmitted using spread spectrum techniques.

According to embodiments of the present invention, one or more sensing modules are in communication with an aggregation device, or an aggregation point. In one embodiment, a sensing module itself is an aggregation device, such as the sensing modules 27 and 41 in FIGS. 4 and 6, respectively. In some embodiments, the aggregation point or device is mobile. In some embodiments, an aggregation device is a computer, cell phone, handheld computer, laptop computer, and/or personal digital assistant. An aggregation point or device preferably includes a user interface. In one embodiment, a Compaq iPaq Microsoft Windows PocketPC user interface is provided. In other embodiments, other user interfaces are provided.

Sensing modules are preferably in communication with one or more other sensing modules. In preferred embodiments, sensing modules form a network, preferably an ad-hoc network with intermittent connections. Each node, or sensing module, on the network can be any combination of a data sink, source, and/or switch. Generally, a data sink will consume messages, a data source will produce messages, and a switch will forward messages to one or more nodes. Sensing modules may interoperate through hardwired, high frequency, wireless, and/or radio frequency connections, as described generally above. In some embodiments, communication is protected through data integrity, confidentiality, and/or non-repudiation techniques, as known in the art.

In embodiments where one or more nodes are connected with a hardwired connection, the configuration is generally static. The node configuration is changed through manual network changes. Particular sensing modules may be multihomed to provide links between other sub-networks. Embodiments of sensing modules having hardwired, or IP links may also include other types of communication capabilities such as wireless links, as described above.

Embodiments of sensing modules having high frequency communication capabilities allow dynamic and intermittent connections. Messages may be broadcast to any other high frequency or wireless link within range to receive. Sensing modules having high frequency links may also have other types of communication links, such as radio-frequency or hardwire IP links, as described above.

Embodiments of sensing modules having radio frequency communication capabilities also allow dynamic and intermittent connections. Sensing modules with radio-frequency links may further be set up in a master/slave arrangement, with both master and slave being independent nodes. In preferred embodiments, the master node is also a switch node. Sensing modules with RF links may also have IP or HF links.

In preferred embodiments, a plurality of sensing modules are in wireless communication with one another, preferably using spread-spectrum protocols or methods, for example, 2.4 GHz spread-spectrum transmission. In other embodiments, communication between a plurality of sensing modules, and/or between a sensing module and a central aggregation point is through a fiber optic cable. In still other embodiments, sensing modules communicate with one another or with a central aggregation point or device via a wired connection or network. Further, a combination of communication methods may be used. In one embodiment, one or more sensing modules communicate with a central data point via a wireless communication link, and one or more aggregation devices communicate with a wired or fiber optic link to a central server or command location. In some embodiments, sensing modules are configured to communicate over a plurality of wireless channels.

Figure 10:
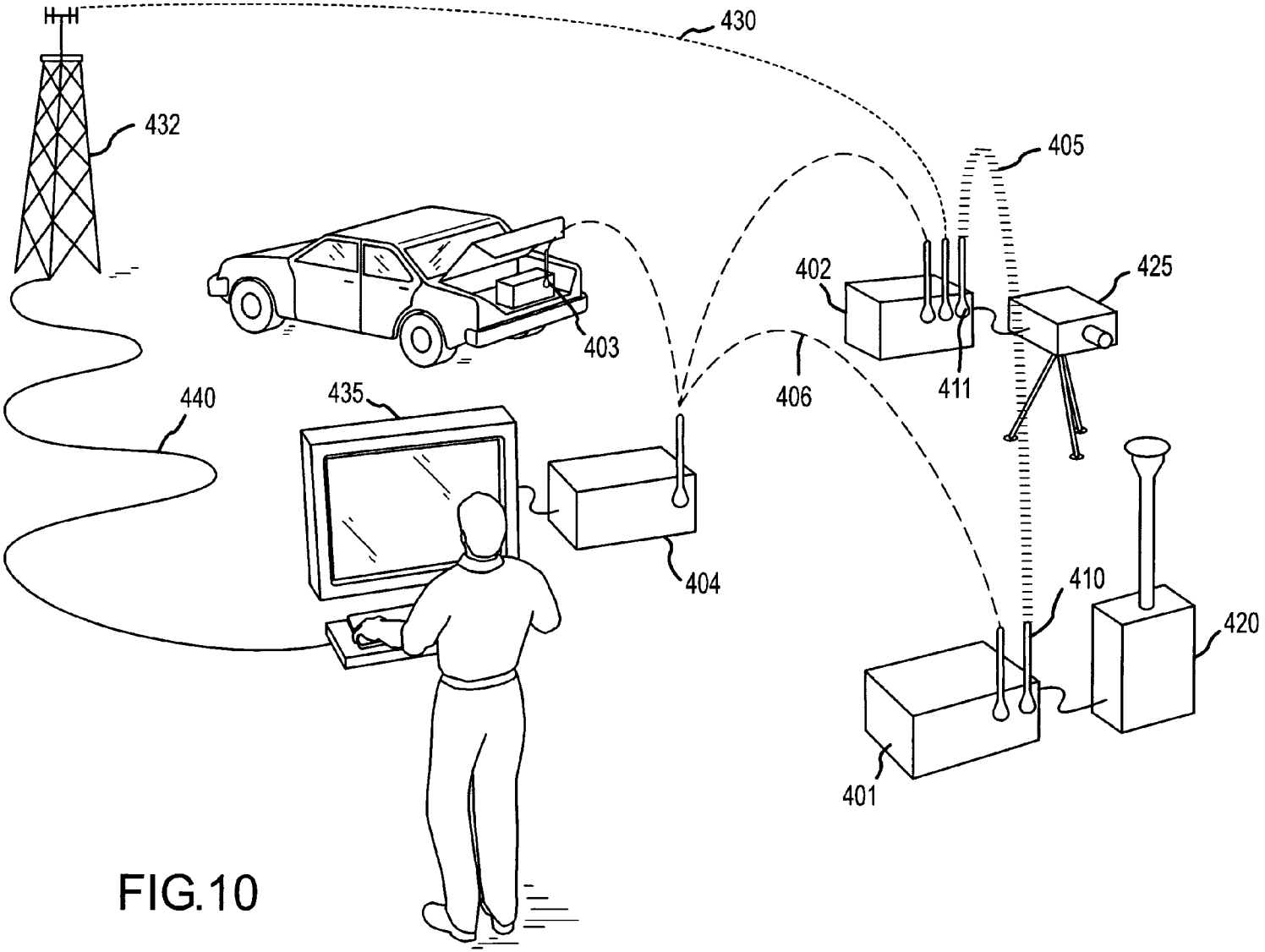
FIG. 10 depicts a network of sensing modules according to an embodiments of the present invention.

In some embodiments, sensing modules communicate according to a plurality of protocols (see FIG. 10). FIG. 10 generally depicts sensing modules 401, 402, and 403 in communication with a data aggregation device 404. Sensing module 401 is coupled to detector 420. Sensing module 402 is coupled to detector 425. Sensing modules 402 and 401 are in communication with one another according to a peer-to-peer protocol 405. Accordingly, sensing modules 401 and 402 include antennas 410 and 411, respectively, that are configured to communicate according to the peer-to-peer protocol 405. Although not shown in FIG. 10 for ease of illustration, the sensing modules 401 and 402 further each include a modem configured for peer-to-peer communication coupled to the antennas 410 and 411. The sensing modules 401, 402, and 403 are each in communication with an aggregation device, the sensing module 404 according to a star topology protocol 406. The sensing module 402 is in communication with a cellular tower 432 according to an analog cellular network control channel protocol 430. A computer 435 is provided for input connected to the sensing module 404. The computer 435 is in communication with the cell phone tower 432 via a wired network 440. Accordingly, arbitrarily complex system configurations supporting multiple tiers, leaf-node chemical detector configurations, and supporting a plurality of communication protocols are generally achievable. Advantageously but optionally, for redundancy and to avoid single point failures, any number of sensing modules can act as store and forward data collection points, either for their own data collection, or as the parent of a broader tiered architecture.

A plurality of sensing modules according to embodiments of the invention generally may form one or more ad hoc networks. Ad hoc networking, or ad hoc routing, refers to networks where message must be delivered, or routed between intermediate nodes where node topologies within a wireless routing region may experience dynamics due to motion or other factors. Nodes can be stationary or moving. Node membership changes seamlessly, that is, with minimal disruption to the network itself.

Peer-to-peer modems generally use lower power than star topology modems. Peer-to-peer modems allow intercommunication between sensing modules located in proximity to each other. In this way, a plurality of sensing modules may be in direct communication with one another without going through a centralized authority, and impact each other's performance—'collective intelligence', as depicted, for example, in FIG. 4. For example, in one embodiment, a plurality of sensing modules and associated detectors are deployed in a subway. One sensing module receiving an alarm from its connected detector may request that another sensing module adjust set points, thresholds, or recheck recent sample histories to, for example, confirm the alarm.

Star topology modems provide communication from a sensing module to an aggregation device or base, through any number of repeaters. Star topology modems can be reconfigured on the fly to communicate with multiple bases, and through varying transmissions paths using different repeaters. Accordingly, star topology modems can react to changing network membership and topologies, and hence, supports ad hoc networking.

In accordance with embodiments of the present invention, a sensing module may include a wireless modem configured to communicate using an analog cellular network (sometimes also referred to herein as a 'cellular modem'). Cellular modems are available and known in the art, such as, for example those provided by Aeris.net. Using control channels of an analog cellular network, the cellular modem sends and/or receives short (~32 bytes), reliable, messages to or from a centralized internet connected network hub within about two minutes, in one embodiment. A cellular modem is used as a separate communication link within a sensing module. The cellular modem may be advantageously used to perform certain tasks, such as to send critical alarm and connected detector state-of-health information (including, for example, tamper-related information), and to receive control information. A cellular modem, in some embodiments, provides a reliable, communication link between a sensing module and an internet connected network authority. For example, a sensing module coupled to a detector in a moving vehicle may transmit alarms to an aggregation point or device of a centralized authority using a cellular modem. It is important to note that cellular modem as described communicates using control channels of a cellular network and is independent of voice use of a cellular network.

Software resident on, or otherwise operatively associated with a sensing module includes functionality to monitor, interpret and/or fuse dispersed data reports for centralized dissemination and/or analysis. Software functionality provided on embodiments of sensing modules may include one, all, or a subset of the following functionalities: system configuration (such as, but not limited to, location, identification, node link status, attached detector and sensor information, and the like); NIC interface management; modem interface management; detector system interface management; detector data collection, parsing, history and trend analysis; environmental sensors interface management, environmental sensors data collection, parsing, history, and/or trend analysis; storage system management; record data storage, XML record forward service, and circular buffer management; sensing module ad-hoc network management, global name service, message passing; remote record access server and a recent record push service; and time synchronization. Software functionality is provided in some embodiments to perform dynamic network bandwidth allocation based on peer-to-peer communication. Multiple sensing module internal clocks are synchronized throughout a network of sensing modules, in an embodiment of the present invention.

Figure 11:
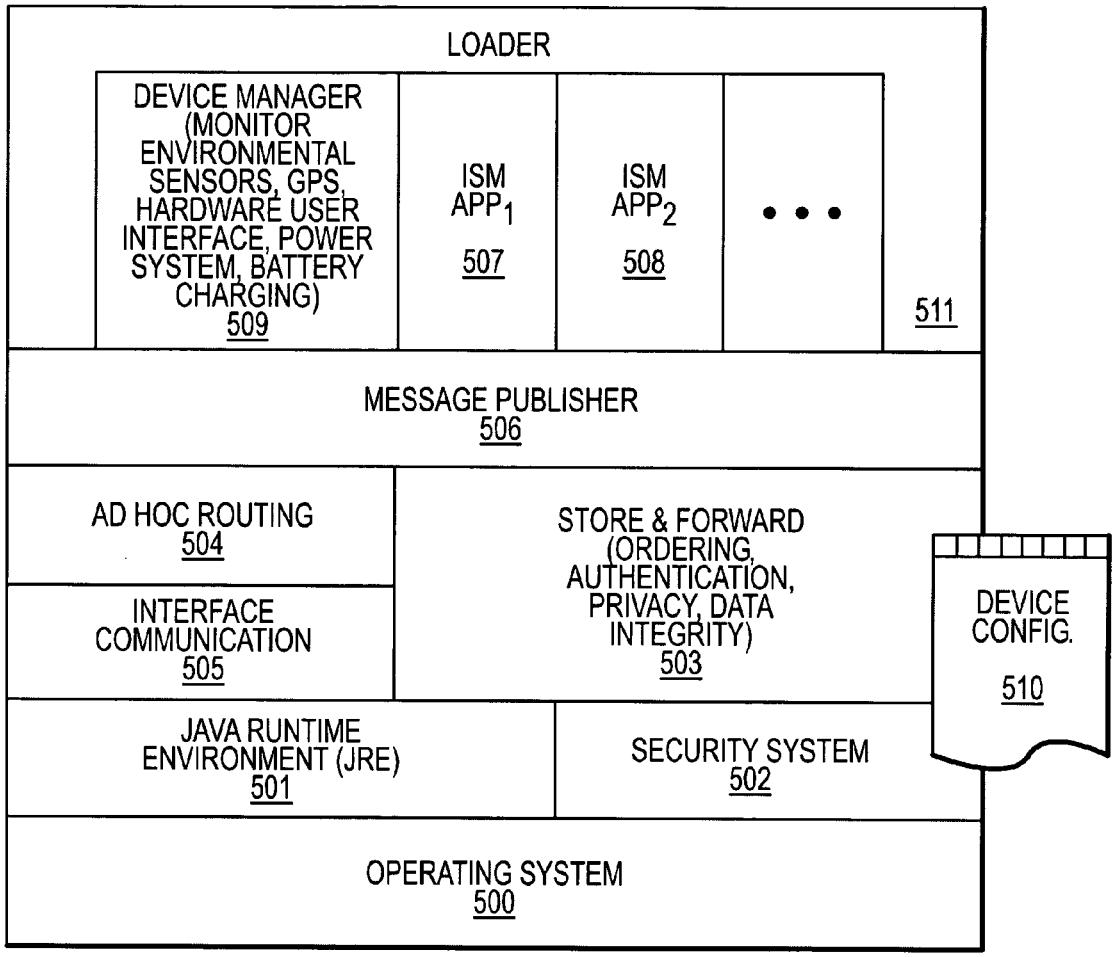
FIG. 11 provides an overview of software functionality provided in a sensing module, according to an embodiment of the present invention.

Software functionality further provided on an embodiment of a single board computer, or other processor and/or memory resident in a sensing module is depicted in FIG. 11. Generally, an operating system 500, or operating environment is provided. In a preferred embodiment, the operating system 500 supports JAVA. In a preferred embodiment, a JAVA runtime environment 501 is provided, although other languages or environments are used in other embodiments. Optionally and advantageously, security services 502 are provided. Store and forward functionality 503 provides for guaranteed message delivery, message authentication, privacy and data integrity, and sensing module configuration.

The store and forward functionality 503 generally provides a link from applications running on a sensing module to the network. It will contain the instructions and methods used to send a message. For example, in one embodiment, store and forward takes each message, tags it with an id, stamps it with a time-to-live value, attaches a sink destination, and places it in an outgoing queue. If a message needs to be propagated to several destinations, in one embodiment, it will be replicated in the queue for each destination. Each message in the queue is passed to a filed on disk and remains there until it is acknowledged from the destination or its time-to-live value expires, in one embodiment. During the construction of the queue any messages existing in the file will, in a preferred embodiment, be automatically placed in the queue.

Ad hoc routing functionality 504, or dynamic path determination, allows each node having the functionality to route messages. Methods used for ad hoc routing include, but are not limited to, virtual geographic routing supporting self-healing and self-organizing of the sensing module network. Other methods are described above. Interface communication functionality 505 is, in a preferred embodiment, provided by a JAVA-based infrastructure that supports Ethernet and serial connections. Message publisher functionality 506 generally serves as an interface between inter-sensing module communication infrastructure and other applications on the host sensing module. The message handler provides a publish/subscribe service; local applications can publish messages through the handler, and can subscribe to and receive a subset of the messages received by the handler.

A packet mechanism may be provided in some embodiments to packetize and reassemble each message as well as optionally process acknowledgements. To packetize a message the mechanism will first check the ready to send signal. If it is possible to send from at least one link, then a message will be de-queued. If the messages time-to-live hasn't expired and the message is available to send, the message will be broken up into packets of no more than the maximum packet size specified. If the message has expired, in one embodiment, it will be removed from the data store and ignored. Each packet will be tagged with a sequence number and a CRC will be added. The packets will then be forwarded to the router. Once all packets have been sent, in one embodiment, the message will be stamped with a send date and re-queued. The send date will be used to determine when a resend is required for this message and the message will not be ready to send until the time to wait has passed. The maximum time to wait before a message is resent is a system property, in one embodiment, that may be configured, for example, by a system administrator. Also, in a preferred embodiment, the time to wait between successive message sends is a system property. The time to wait between sends will optionally but advantageously help reduce the risk of congesting the network if a large queue of messages exits and the transport layer is ready to send.

In one embodiment, a message is reassembled after all packets for the message are received. Until such time each packet must pass a CRC check and wait in an array until the entire sequence is available. Once all packets are available the message is assembled and put into the received queue. An acknowledgement is then sent to the destination node. The packet mechanism receives acknowledgement packets from the router, in a preferred embodiment. These are special packets that contain a message id. They are sent from the destination packet assembler once a message has been successfully delivered, in a preferred embodiment. The message id is extracted from the packet and the message is removed from the data store and queue.

The purpose of the router, according to an embodiment of the present invention, is to take each packet and find an appropriate link based on the destination node id or check for packets to this destination and pass them up to the packet mechanism. In this system, routing can be simplified due to minimal network traffic as well as the requirement that reliability and not performance is important. One simple routing technique is to flood the network with each packet.

A router is provided, in some embodiments, to take each packet and find an appropriate link based on the destination node id or check for packets to this destination and pass them up to the packet mechanism. In a preferred system, routing can be simplified due to minimal network traffic as well as the requirement that reliability and not performance is important. In one embodiment, a routing technique comprising flooding the network with each packet is employed. This means that the router will generally maintain a packets hop count as well as keep a queue of routed packets to eliminate the possibility of a packet creating network congestion problems. In some embodiments, efficiency is increased by flooding only the dynamic connections of the network—and the IP connections are not flooded. Each source or switch sensing module, in a preferred embodiment, routes based on the following rule set: 1) Incoming messages that were previously routed are not rerouted; 2) If the sensing module has an IP link and the destination node is a hardwired channel, the IP address from the configuration file 510, see FIG. 11 is used to send the message directly; 3) If the sensing module has an IP link and the destination sensing module or device is not a hardwired channel, the message is sent to each hardwired switch sensing module or device. Also, if the sensing module has a high frequency or RF link, broadcast the message to each link.

In some embodiments, the router accommodates multiple implementations and chains them together. Each implementation in the chain can apply a rule set: if the route implementation can't find a route, the message is passed to the next implementation in the chain until the end of the chain is reached and an exception is thrown.

A data link layer is provided, in a preferred embodiment, to provide the communication with the underlying network. It handles tasks associated with opening and/or closing connections and sending and receiving message packets as well as provide a ready-to-send signal. In the case of IP hardwired network communication, this implementation is a datagram socket opened using a user-configured port on a specified IP link.

Sensing module applications 507 and 508 represent control and/or configuration specific for, or associated with, attached detectors and/or sensors. Device Manager 509 provides the ability to monitor sensors, optional GPS, hardware, user interface, power system, battery charging, and/or other device incorporated into the ISM. Loader 511 supports simultaneous execution of multiple applications, such as, in one embodiment, one or more models. Device configuration 510 supports the configuration of one or more devices integral to or in communication with the sensing module. A loader 511, in a preferred embodiment, is a Java application that is intended to run on a single board computer, but can run on any networked computer with suitable JVM installed. In other embodiments, other languages may be used to implement a loader. The loader is used to remotely upload and execute programs on a computer. The loader runs, in a preferred embodiment, as a daemon process.

Functionality provided by the loader 511 includes some or all of the following: 1) receive Java byte-code from a remote client and store the code on the local filesystem; 2) perform generic file transfers; 3) execute Java byte-code stored on the local filesystem; 4) terminate Java processes initially executed by the loader; 5) allow clients to communicate with running processes.

In a preferred embodiment, the loader is intended to accept multiple types of connections from clients, such as serial or RF and TCP/IP. In one embodiment, the loader will interface with the network through a publisher/subscriber mechanism. The Store and Forward Implementation interfaces with the network through TCP/IP, RF/serial, and the like, as described above and manages these interfaces. The Message Publisher 506 runs on top of the Store and Forward mechanism 503, and receives messages received by the Store and Forward mechanism, in a preferred embodiment. The Loader uses a Message Subscriber to subscribe to Loader Messages, so the Message Publisher forwards Loader Messages to the Message Subscriber, in a preferred embodiment. The Loader 511 receives Loader Messages and sends outgoing messages through the Message Subscriber, which forwards the message to the Message Publisher. The Message Publisher sends out the message over the network. A Loader client communicates with the Loader over the network using the same network interface mechanism on the client side, in one embodiment. Loader processes, or models, also subscribe to and send out messages using the same mechanism, in one embodiment.

Besides the network interface, the loader includes the following components, in a preferred embodiment: a request processor to service client requests and a model manager to organize processes and models that the user loads.

Actions perform the loader's work. Actions can modify the loaded model, such as adding new files to a model, loading new models, and/or deleting old models, in one embodiment. Model Actions, in some embodiments, involve retrieving data from the client, such as files, and making calls to the Model Manager. Process Actions, in some embodiment, involve interacting with running Loader Processes (sometimes also referred to as 'models' or 'sensing module applications' herein). Process Actions, in some embodiments, involve talking to the Loader Process through the Loader Process Interface, such as sending system messages. Miscelleous Actions perform general tasks that do not fall in the above categories.

The Model Manager helps organize models loaded onto the computer using the loader. Each model will get its own folder to store its executable files. Each model folder will contain a configuration file containing at least a model ID and a primary executable file.

The Model Register searches for model folders, and creates a Model object for each module folder it finds. It then loads the module configuration from the models configuration files. To start a process, the model object executes the entry point class file.

The loader 511 has the ability to start models, according to embodiments of the present invention. Embodiments of models that are started by the loader have an entry point class. The entry point class is much like a main class, it is essentially the "entry point" of the process. The entry point class is a subclass of the Loader Process parent class. The Model Manager executes the Booter in a separate JVM, in one embodiment of the invention, and the Booter then starts the loader model. To start the loader model, the Booter executes the process's entry point class (called the run method). The Loader Process parent class defines and manages the process's interface. The process receives messages from the network from its Message Subscriber. The process uses the Message Subscriber to subscribe to any messages it expects to receive over the network, and to send messages out on the network. The process receives messages from the loader on a local UDP port.

The System Monitor subsystem of the sensing module software provides the capability to monitor components of a sensing module. The data the subsystem provides can be gathered from hardware or software components. It can include hardware measurements, such as system temperature and battery level or an inventory of hardware associated with the node. For sensing module software components it can provide data such as, memory and processor usage, network throughput, configuration information, and/or serious software failures and the like.

Embodiments of System Monitor can operate in several modes, including user-initiated query and real-time monitor.

User-initiated mode provides a snapshot of the hardware and software components and available health data for the system. This information should be available through a lightweight GUI application capable of running on a PDA or other resource limited device. Using this application a user could query any and/or all sensing modules in a network and then drill down to display specific system and health data for each sensing module.

Real-time monitor mode is designed to constantly monitor a node and access the health of critical components. It will query the health data and then analyze the results against a series of threshold values. If it determines the sensing module is approaching a critical state an alarm will be generated. The alarm will be logged, according to an embodiment of the present invention, and a System Administrator will be notified.

Each module in a sensing module network will include a health monitor. It would exist as a singleton within each sensing module and serve as the entry point to obtain health data as well as the real-time alarm generator. The purpose of the health providers is to supply health data from each component of a sensing module. According to embodiments of the present invention, a health provider comprises an interface which each data supplier class implements.

In some embodiments, a model is run on a sensing module processor. For example, in one embodiment, a model is provided in a module application, such as the application 507 and 508 in FIG. 11. By running a model on the processor, herein is generally meant that the sensing model itself has sufficient processor, hardware and/or software capability to predict, estimate, or interpret, data received from a sensor given other information about the situation or environment. That is, the sensing module receives data from one or more sensors or detectors or other devices and uses that data to predict or influence an expectation for a value to be received from one or more other sensors or detectors. By way of example, in one embodiment, a model is provided relating time and distance data to the expected roll rate on a weapon. The sensing module receives data regarding the elapsed time and traveled distance, and provides this data as input to a roll rate model. The roll rate model generates a predicted value for roll rate. The sensing module then compares received roll rate information with the expected or predicted roll rate value. If the actual roll rate value is not within a specified range with respect to the expected or predicted value, the sensing module generates an alarm to transmit to another device or central data aggregation device or point. Generally, then a software and/or hardware model is provided in embodiments of sensing modules. A sensing module processor generates expected or predicted values, and/or a range of acceptable values for a detector parameter. The sensing module generates an alarm when the model is violated. In some embodiments, the model is violated when a measured parameter does not fall within a range of the expected or predicted parameters. In other embodiments, the sensing module generates an alarm when a measured parameter does fall within a range of expected or predicted parameters. For example, in one embodiment, a model is provided to generate a set of expected values for a detector reading when a chemical, biological, or radiological threat was present, and the sensing module generates an alarm when measured data are received that agree with the model. According to embodiments of the invention, a plurality of models may be executed simultaneously that model one particular detector. Further, in some embodiments, a model may predict or interpret data from a plurality of detectors and/or environmental sensors. In still further embodiments, a model may take data received from other sensing modules and/or other detectors as input to the model. That is, data received form one or more other sensing modules and/or detectors may effect the performance or computations performed by a particular model.

In some embodiments, a "wakeup" functionality is provided. A sensing module may be dormant and uncommunicative for some period of time. When sent a specific command via the wireless interface, the sensing module 'wakes up' and begins monitoring and analyzing incoming data. In preferred embodiments the period of uncommunicative time may be between 5 minutes and 5 years.

Sensing module networks generally find use in a variety of applications, including telemetry, health of weapons, industrial applications, and situational understanding, as described further in D. M. Nicol, et. al., "Large-Scale Information Systems" Sandia SAND Report 2001-8086, unlimited release, printed November 2000, hereby incorporated by reference.

In some embodiments, a sensing module serves as a communication bridge between connected detectors, environmental sensor units, and networks coupled to the sensing module using various interfaces. For example, as described above, embodiments of a sensing module have at least one Ethernet interface, and some embodiments have a plurality of Ethernet interfaces for communicating with one or more external devices or networks. Further, embodiments of a sensing module have at least one wireless modem for communicating with one or more external devices or networks. In some embodiments, both a plurality of Ethernet interfaces and a plurality of wireless modems are present in a sensing module. Accordingly, embodiments of a sensing module bridge (that is, mediate communication) between a wireless communication link and an Ethernet interface while simultaneously serving as a gateway or bridge to a connected detector.

In a preferred embodiment, one or a plurality of sensing modules are deployed to provide distributed information collected from a site, region, building, system, or other environment. For example, in one embodiment one or more sensing modules are located in one or more subway or other transit locations. In one embodiment a system including one or a plurality of sensing modules are located, at least in part, within an airport. Additionally or alternatively one or more sensing modules are located on or integral with a subway or other mobile transit vehicle. Location of various sensing modules deployed to monitor a particular environment are chosen, in a preferred embodiment according to various engineering judgments relative to the variables or agent being monitored. For example, expected airflow patterns in a station or vehicle, possible threats, physical security and ease of access for maintenance, and the like may influence the position of one or more sensing modules in a network. The number of sensing modules deployed is determined by the coverage desired and, in one embodiment, is determined by the range of particular detector used. In some embodiments, fewer sensing modules are deployed than necessary for full or complete physical coverage of a system, location, or environment.

In this manner, complex environments—including mobile components such as cars, subways, trains, airplanes, and the like—may be monitored for the presence of a threat—such as a chemical, biological, or radiological agent. Sensing modules, in some embodiments, are further configured to facilitate simulation. That is, the modules may execute a model indicating the presence of a threat, and on the basis of this modeled threat, generate an alarm or other report.

In an embodiment of the present invention, sensing modules are used in a joint test assembly environment to test functionality of a weapon or other device, and data loss on the order of 1 bit per million is required. In other embodiments, a stricter or looser data loss rate may be specified.

Embodiments of the invention advantageously implement the methods and procedures described herein on a general purpose or special purpose computing device, such as a device having a processor for executing computer program code instructions and a memory coupled to the processor for storing data and/or commands. It will be appreciated that the computing device may be a single computer or a plurality of networked computers and that the several procedures associated with implementing the methods and procedures described herein may be implemented on one or a plurality of computing devices. In some embodiments the inventive procedures and methods are implemented on standard server-client network infrastructures with the inventive features added on top of such infrastructure or compatible therewith.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. In particular various embodiments disclosed separately above may be practiced together in any combination. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

We claim:

1. A sensing module comprising:

at least one detector interface coupleable to a detector;

at least one environmental sensor interface coupleable to an environmental sensor unit;

at least one processor configured to receive data from the at least one detector interface and the at least one environmental sensor interface during operation, the at least one processor further being operable to generate transmit information based, at least in part, on data received from the detector interface and the environmental sensor interface;

at least one wireless modem in communication with the at least one processor through a plurality of interfaces, the wireless modem being operable to transmit the transmit information; and a power module coupleable to a power source and configured to provide power management for the wireless modem, the at least one processor, and the environmental sensor interface.

2. A sensing module according to claim 1, further comprising a plurality of interfaces, each coupleable to a detector.

3. A sensing module according to claim 1, further comprising a plurality of interfaces, each coupleable to an environmental sensing unit.

4. A sensing module according to claim 1, wherein the wireless modem is configured to communicate according to a peer-to-peer protocol.

5. A sensing module according to claim 1, wherein the wireless modem is configured to communicate according to a star topology protocol.

6. A sensing module according to claim 1, further comprising a plurality of wireless modems and a plurality of antennas, each in communication with at least one of the modems.

7. A sensing module according to claim 6, wherein at least one of the wireless modems is configured to communicate according to a peer-to-peer protocol and at least one of the wireless modems is configured to communicate according to a star topology protocol.

8. A sensing module according to claim 1, wherein the power management comprises switching between an internal and an external power source.

9. A sensing module according to claim 8, wherein the power management further comprises charging an internal power source.

10. A sensing module according to claim 1, wherein the at least one processor is configured to execute a model to predict a measurement from the detector interface.

11. A sensing module according to claim 10, wherein the at least one processor is further configured to compare at least some of the data received from the detector interface with the prediction.

12. A sensing module according to claim 10, wherein the at least one processor is further configured to receive data from a second sensing module, and predict a measurement from the detector interface based, at least in part, on data received from the second sensing module.

13. A sensing module according to claim 1, wherein the at least one processor is configured to execute a model to interpret a measurement from the detector interface.

14. A sensing module according to claim 1, wherein the detector to which the detector interface is coupleable is chosen from a group of detectors including chemical, biological, and radiological detectors.

15. A sensing module according to claim 1, wherein the sensing module is mobile.

16. A method for detecting a condition and generating an alarm when the condition is detected, the method comprising:

predicting detector data based, at least in part, on a model of the condition;

receiving data indicative of the condition; and generating an alarm based, at least in part, on a comparison between the received data and the predicted data, the alarm being generated if the received data is in accordance with the model.

17. A method for detecting according to claim 16, further comprising receiving data indicative of a second condition and wherein the predicting is further based on the data indicative of the second condition.

18. A method for detecting according to claim 16, further comprising aggregating the received data indicative of a plurality of the conditions; and generating the alarm based, at least in part, on the aggregated received data.

19. A method according to claim 18, further comprising modifying the manner in which the detector data are predicted.

20. A method according to claim 18, further comprising modifying the model.

21. A method according to claim 16, the method further comprising:

mediating communication between a detector and a first network; and simultaneously mediating communication between a sensing module and a second network.

22. A method according to claim 21, wherein said first network is a wireless network and said second network is a wired network.

23. A method according to claim 21, wherein said second network is an Ethernet network.

24. A detection system comprising:

a plurality of detection modules, each of the detection modules comprising:

at least one environmental sensor interface coupleable to an environmental sensor unit;

at least one processor configured to receive data from the at least one environmental sensor interface during operation, the at least one processor further being operable to generate transmit information based, at least in part, on data received from the at least one environmental sensor interface;

at least one wireless modem in communication with at least one processor through a modem interfaces, the wireless modem being operable to transmit the transmit information; and a power module coupleable to a power source and configured to provide power management for the wireless modem, the at least one processor, and the at least one environmental sensor interface; and an aggregation device in communication with the plurality of detection modules according to a star topology protocol; wherein the aggregation device is configured to control one or more of the detection modules.

25. A detection system according to claim 24, wherein the detection modules are in communication with each other according to a peer-to-peer protocol.

26. A detection system according to claim 24, wherein the aggregation device comprises a sensing module.

27. A method for detecting a condition and generating an alarm when the condition is detected, the method comprising:

providing a plurality of the sensing modules, each of the sensing modules being operable to provide data indicative of the condition;

forming an ad hoc network of the sensing modules;

predicting detector data based, at least in part, on a model of the condition;

receiving data indicative of the condition from the sensing modules; and generating an alarm based, at least in part, on a comparison between the received data and the predicted data.

28. A method for detecting according to claim 27, wherein the alarm is generated if the received data violates the model.

29. A method for detecting according to claim 27, wherein the alarm is generated if the received data is in accordance with the model.

30. A method for detecting according to claim 27, further comprising receiving data indicative of a second condition; and wherein the predicting is further based on the data indicative of a second condition.

31. A method for detecting according to claim 27, further comprising providing a data aggregation device in communication with the plurality of sensing modules; and controlling at least one of the sensing modules using the data aggregation device.

32. A method according to claim 31, wherein the controlling comprises modifying the behavior of at least one detector.

33. A method according to claim 31, wherein the controlling comprises modifying the model.

34. A method according to claim 27, the method further comprising:

mediating communication between a detector and a first network; and simultaneously mediating communication between a sensing module and a second network.

35. A method according to claim 34, wherein said first network is a wireless network and said second network is a wired network.

36. A method according to claim 34, wherein said second network is an Ethernet network.

* * * * *